US005456507A

United States Patent [19]

Jones

[11] Patent Number: 5,456,507

[45] Date of Patent: Oct. 10, 1995

[54] DEADBOLT STRIKE PLATE

[76] Inventor: Wayne G. Jones, P.O. Box 23492, Nashville, Tenn. 37202

[21] Appl. No.: 294,304

[22] Filed: Aug. 23, 1994

[51] Int. Cl.[6] ..... E05B 15/02

[52] U.S. Cl. ..... 292/340; 292/346

[58] Field of Search ..... 292/340, 346

[56] References Cited

U.S. PATENT DOCUMENTS

| | | | |
|---|---|---|---|
| 2,470,735 | 5/1949 | Young | 292/340 |
| 3,815,945 | 6/1974 | Lamphere | 292/340 |
| 4,065,162 | 12/1977 | Schlage | 292/340 |
| 4,186,954 | 2/1980 | Detlefs | 292/340 |
| 4,474,394 | 10/1984 | Crepinsek | 292/340 |
| 4,547,009 | 10/1985 | Allen | 292/340 X |
| 4,550,939 | 11/1985 | Babb, Jr. et al. . | |
| 4,580,824 | 4/1986 | Asp . | |
| 4,635,399 | 1/1987 | Gehrke et al. . | |
| 4,690,445 | 9/1987 | Hartley | 292/346 X |
| 4,809,400 | 3/1989 | Allen | 292/340 X |
| 4,858,384 | 8/1989 | Blankenship . | |
| 5,070,650 | 12/1991 | Anderson . | |
| 5,088,780 | 2/1992 | Doherty | 292/346 |
| 5,127,690 | 7/1992 | Kim et al. . | |

*Primary Examiner*—Rodney M. Lindsey
*Attorney, Agent, or Firm*—Richard C. Litman

[57] ABSTRACT

A strike plate assembly which includes a rigid unitary strike adapted for use with a door jamb having an inner bolt receiving face and a door stop portion. The strike includes a bolt receiving face plate, a door stop plate, and a offset plate joining the bolt receiving face plate and the door stop plate. A plurality of anchor cylinders or pins extend from both the bolt receiving face plate and the door stop plate. The strike plate is secured to both the bolt receiving face and the door stop portion of the door jamb. The anchor pins extend through the door jamb and into the door support structure behind the door jamb.

9 Claims, 2 Drawing Sheets

DEADBOLT STRIKE PLATE

BACKGROUND OF THE INVENTION

1. Field of the Invention

The present invention relates to door lock apparatus, and particularly to mounting of the door strike for a deadbolt security lock.

2. Description of the Prior Art

The door frame and jamb assemblies of residential dwellings and some commercial buildings are typically constructed at least partially of wood. Such assemblies have proven to be susceptible to unauthorized entry by component failure of the jamb/strike components. Typically a metal strike plate is mounted with screws to the jamb portion of the door frame. The strike plate receives the deadbolt when the latter is thrown to the extended lock position. Such strike plates are typically attached with only two screws, while the door hinges on the opposite edge of the door are mounted with at least six screws. Consequently, the edge of the door on which the lock is mounted is the weaker side. In the typical installation, an intruder may apply a moderate amount of force to the weaker edge of the door using a pry bar. The result of this action may include cracks propagating in the wood door frame and or jamb, or the bending of the attachment. Both results allow the screws to fall out and release the door.

This problem is compounded by the fact that the door frame itself may be constructed from relatively thin wood which is inserted into the support framing and nailed thereto. This design creates two additional problems. First, there is usually a space left between the support framing and the door frame. When screws are inserted through the door frame, they must extend through the open space before engaging the support frame. The space left between the door frame and the support framing creates the possibility that the door frame can be split and the screws readily bent when an intruder applies prying force to the locked door.

Prior art latches have addressed this problem but have failed to provide a rigid unitary strike which spans both the inner bolt and door stop portion of a door jamb and also provide a plurality of anchor pins.

U.S. Pat. No. 4,550,939, issued to John H. Babb, Jr. on Nov. 5, 1985, discloses a Security Strike Assembly which includes a strike plate that is mounted directly on a door framing by rigid bushings and mating screws. The bushing, extending from an interior surface of the strike plate, are closely received in holes drilled into the door framing. Each screw extends through a mating aperture in the strike plate, through a central aperture of a bushing, and into the door frame.

U.S. Pat. No. 4,635,399, issued to David E. Gehrke on Jan. 13, 1987, discloses a Door Jamb Support which includes an L-shaped reinforcing plate having a recessed portion with an opening therethrough positioned to be in alignment with a door latch on a door, a strike plate positionable within the recessed portion having an opening therethrough in alignment with the opening in the reinforcing support plate, and an adjustment mechanism for adjusting the position of the strike plate opening with respect to the support plate opening.

U.S. Pat. No. 4,809,400, issued to Mark L. Allen on Mar. 7, 1989, discloses Security Hardware for Doors which includes a flat piece of metal bent into a J-shaped member and secured to the door jamb. The J-shaped member includes a pair of aligned buck pin apertures provided in the overlapping spaced apart portion of the J-shaped element. A separate buck pin is inserted through each of the apertures and into the wall structure beyond a door frame.

U.S. Pat. No. 4,858,384, issued to James E. Blankenship on Aug. 22, 1989, discloses a Door Jamb Reinforcement Plate which includes an elongated support plate having an L-shaped cross section with a first side to overlap the inside of a door jamb, and a plurality of vertically arrayed punch-out tabs located along a length of the first side that may be selectively punched out to facilitate alignment with the striker or bolt of each door lock.

U.S. Pat. No. 5,070,650, issued to Edward R. Anderson on Dec. 10, 1991, discloses a Door Jamb Reinforcing Apparatus which includes a first and a second flat elongated plate. The first plate is adapted for mounting flush with a portion of the inner bolt receiving face of a door jamb. The second plate has an L-shaped configuration and has one side adapted to overlie the first plate.

U.S. Pat. No. 5,127,690, issued to Kenneth Kim et al. on Jul. 7, 1992, discloses a Door Safety Striker Plate Assembly which includes a striker plate secured to the jamb, overlapping adjustable plates secured to the door stop or jamb shoulder, means carried on the adjustable plates to allow adjustment of these plates to width of the door stop, and stabilizing means interconnecting the adjustable plates.

None of the above inventions and patents, taken either singly or in combination, is seen to describe the instant invention as claimed.

SUMMARY OF THE INVENTION

The present invention includes a strike plate assembly which further includes a rigid unitary strike adapted for use with a door jamb having an inner bolt receiving face and a door stop portion. The strike includes a bolt receiving face plate, a door stop plate, and an offset plate joining the bolt receiving face plate and the door stop plate. A plurality of anchor cylinders or pins extend from both the bolt receiving face plate and the door stop plate. The strike plate is secured to both the bolt receiving face and the door stop portion of the door jamb. The anchor pins extend through the door jamb and into the door support structure behind the door jamb. The anchor pins engage the support frame in two different horizontal planes and in three different vertical planes to provide for a stronger locking mechanism.

Accordingly, it is a principal object of the invention to provide an unitary strike plate which spans both the inner bolt receiving face and the door stop portion of a door jamb.

It is another object of the invention to provide a strike plate with a plurality of anchor pins which extend through the door jamb to engage the door support structure.

It is a further object of the invention to provide a strike which may be includes as part of an originally manufactured door assembly or added to existing doors.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
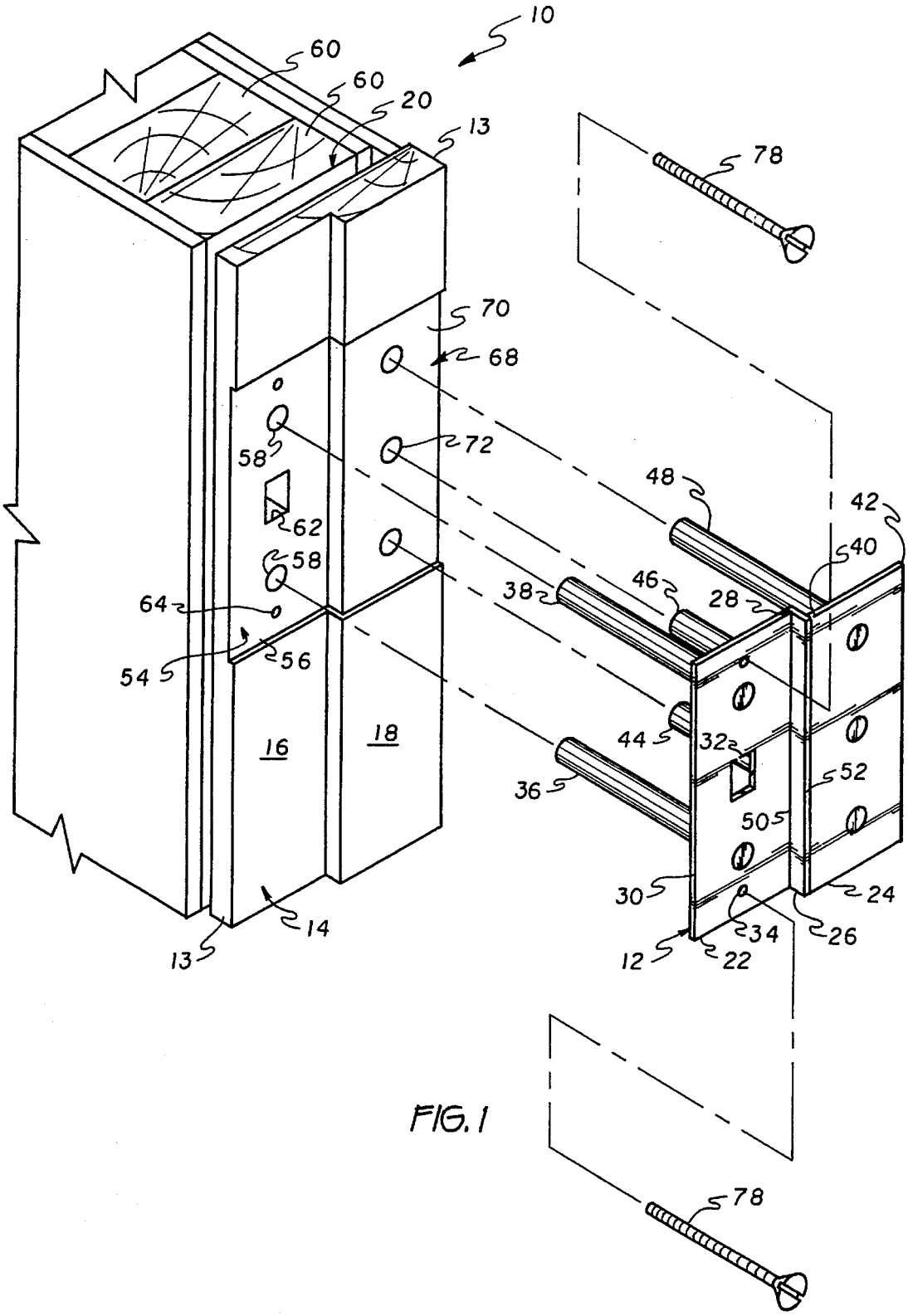
FIG. 1 is an exploded perspective view of the strike plate assembly of the present invention.

Referring to FIG. 1, the strike plate assembly 10 of the present invention is depicted in exploded fashion including the strike plate 12, a door frame 13 with a door jamb 14 having both an inner bolt receiving face 16 and a door stop portion 18, and the support frame 20 associated with the door.

Figure 2:
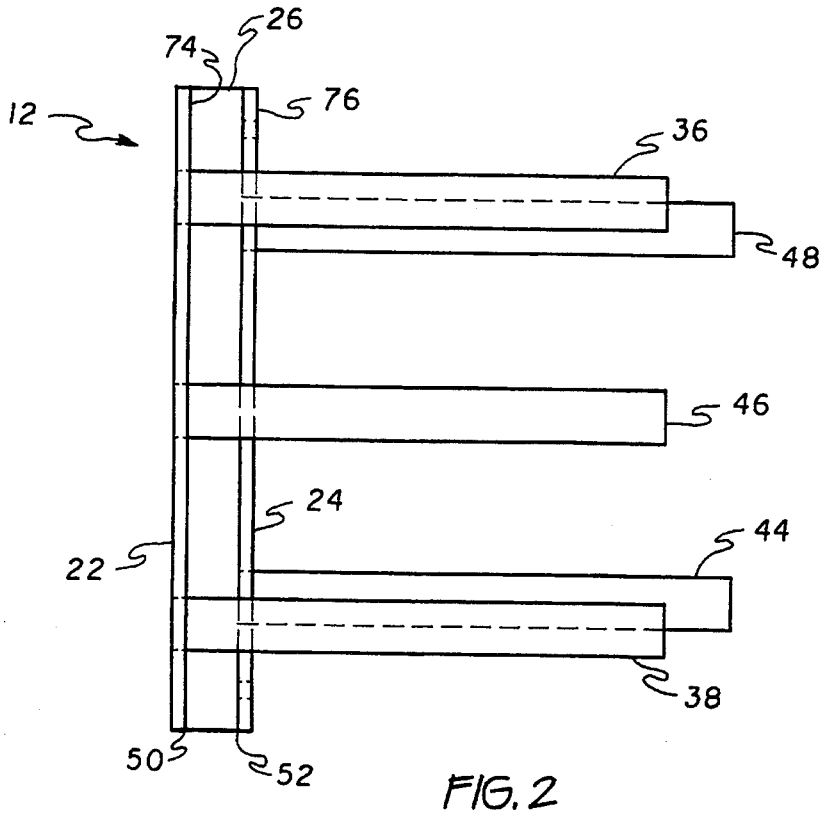
FIG. 2 is a side elevational view of the strike plate of the present invention.

The strike plate 12, as best shown in FIG. 1 and FIG. 2, includes a bolt receiving face plate 22 and a door stop plate 24 joined by an offset plate 26. The bolt receiving face plate 22 has a face plate first edge 28, a face plate second edge 30 opposite the face plate first edge 28. The bolt receiving face plate 22 also includes a bolt receiving aperture 32 and a plurality of spaced apart mounting screw apertures 34. A first anchor cylinder or pin 36 and second anchor cylinder or pin 38 are spaced apart and attached to the bolt receiving face plate 22. Each of the anchor pins 36,38 are substantially normal to the bolt receiving face plate 22 and extend away from the plate 22.

The door stop plate 24 is disposed substantially parallel to the bolt receiving face plate 22. The door stop plate 24 has a stop plate first edge 40, a stop plate second edge 42 opposite the stop plate first edge 40, and a number of anchor cylinders or pins 44,46,48 extending from the plate 24. A third anchor pin 44, fourth anchor pin 46, and fifth anchor pin 48 are spaced apart and attached to the door stop plate 24. Each of the anchor pins 44,46,48 project substantially normal to the door stop face plate 24 in the same direction as the first and second anchor pins 36, 38.

The offset plate 26 has opposite edges 50,52 respectively joined to the face plate first edge 28 and the stop plate first edge 40. The offset plate 26 is disposed normal to the bolt receiving face plate 22 and the door stop plate 24.

Figure 3:
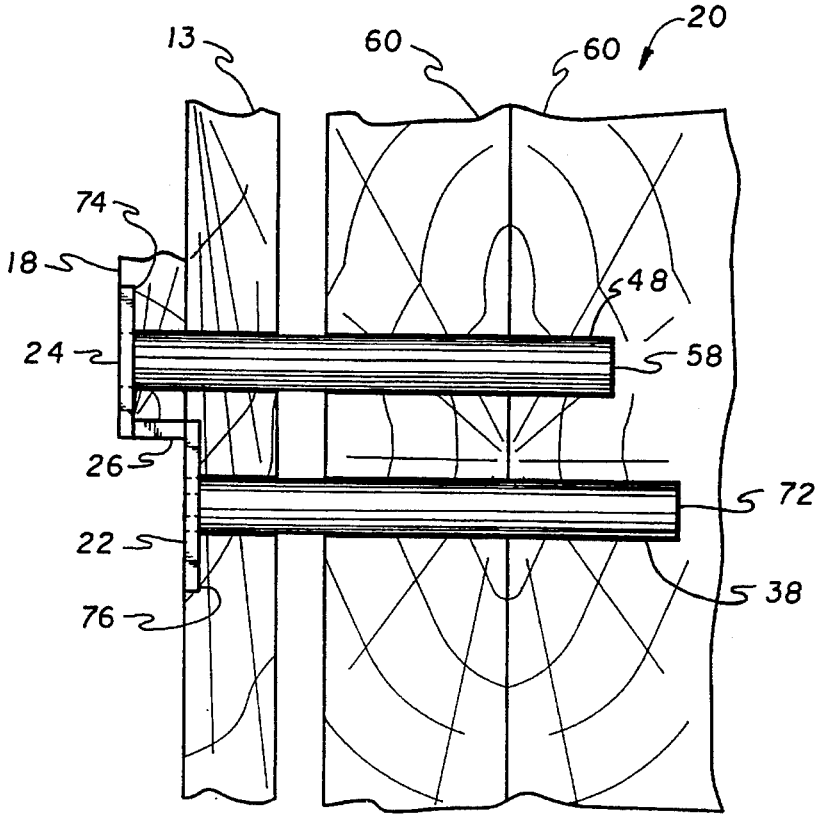
FIG. 3 is a top view of the strike plate secured to a door structure with the door structure shown in partial section.

To accommodate the strike plate 12, the door jamb associated with the strike plate 12 includes a mortise portion 54 defined in the inner bolt receiving face 16. A bottom surface 56 of the mortise portion 54 includes a number of bores 58 extending through the door jamb 14, door frame 13, and into the support frame The support frame 20 typically consist of two studs 60 spaced from the door frame 13 as shown in FIG. 1 and FIG. 3. The bores 58 will typically extend into but not completely through the studs 60. The bottom surface 56 will also include a bolt receiving recess 62 and a number of attaching screw bores 64.

A second mortise portion 68 is defined in the door stop portion 18. The second mortise 68 includes a second bottom 70, with a number of bores 72 extending through the door frame 13 and into the support frame 20 as described above for the bores 58 of the inside bolt receiving face 22.

Back surfaces 74,76 of both the bolt receiving face plate 22 and door stop plate 24 are secured to the bottom surfaces 56,70 of the mortises 54,68, using mounting screws 78. The mounting screws 78 have a length sufficient to extend through the mounting screw aperture 34, and threadedly engage the door frame 13 and the studs 60 of the door support frame 20. As shown in FIG. 3, the anchor pins 36,38,44,46,48 are closely received in the bores 58,72.

The strike plate 12 may be included as part of a originally manufactured prefabricated door unit or installed as an assembly on existing door units. The assembly 10 may be used in used in the manner of conventional strike plates, and primarily with deadbolt locking mechanism. The strike plate of the present invention, however, may also be used with other types of latching mechanism.

The embodiment of the present invention shown is typically made of steel or other suitable material. Both the bolt receiving face plate 22 and door stop plate 24 have a length of 6 inches, a width of 2⅜ inches, and a thickness of ⅛ inch. The offset plate 26 has a width of ½ inch. These dimensions may be varied to accommodate door jambs of varying dimensions. The anchor pins 36,38,44,46,48 have a diameter of ½ inch and typically have a maximum length of 4½ inches. However the length of the anchor pins may vary to accommodate support frames and door frames of varying thickness. The anchor pins may be secured to the plates using various conventional methods well known in the art.

It is to be understood that the present invention is not limited to the sole embodiment described above, but encompasses any and all embodiments within the scope of the following claims.

What is claimed is:

1. A strike plate for use with a door jamb of the type having an inner bolt receiving face and a door stop portion, said strike plate comprising:

a bolt receiving face plate having a bolt receiving aperture and including a face plate first edge, a face plate second edge opposite said face plate first edge, and a mounting screw aperture;

at least one face plate anchor cylinder attached to said bolt receiving face plate and projecting therefrom in a first direction, said at least one face plate anchor cylinder adapted to be inserted through the bolt receiving face and into an underlying door support structure to reinforce the mounting of said strike plate to the door jamb;

a door stop plate disposed substantially parallel to said bolt receiving face plate, said door stop plate having a stop plate first edge, and a stop plate second edge opposite said stop plate first edge;

at least one door stop anchor cylinder attached to said door stop plate and projecting therefrom in said first direction, said at least one door stop anchor cylinder adapted to be inserted through the door stop portion and into the underlying door support structure to reinforce the mounting of said strike plate to the door jamb; and an offset plate having opposite edges respectively joined to said face plate first edge and said stop plate first edge.

2. The strike plate according to claim 1, wherein said offset plate is disposed generally normal to said bolt receiving face plate and said door stop plate.

3. The strike plate according to claim 2, wherein said at least one face plate anchor cylinder is substantially normal to said bolt receiving face plate, and said at least one door stop anchor cylinder is substantially normal to said door stop plate.

4. The strike plate according to claim 3, wherein said at least one face plate anchor cylinder includes a plurality of face plate anchor cylinders.

5. The strike plate according to claim 4, wherein said plurality of face plate anchor cylinders includes, spaced apart and projecting substantially normal to said bolt receiving face plate, a first anchor cylinder and a second anchor cylinder.

6. The strike plate according to claim 5, wherein said at least one door stop plate anchor cylinder includes a plurality of door stop plate anchor cylinders.

7. The strike plate according to claim 6, wherein said plurality of door stop plate anchor cylinders includes, spaced apart and projecting substantially normal to said door stop plate, a third anchor cylinder, a fourth anchor cylinder, and a fifth anchor cylinder.

8. A strike plate assembly in combination with a door jamb and a door supporting frame, said door jamb having an inner bolt receiving face and a door stop member, said striker plate assembly comprising:

a bolt receiving face plate having a bolt receiving aperture and including a face plate first edge, a face plate second edge opposite said face plate first edge, a front surface, an opposing back surface, and a mounting screw aperture extending from said front surface to said back surface;

a mortise portion in said inner bolt receiving face, said mortise portion having a bottom, said bottom having a bore extending through said door jamb and into said door support frame, with said back surface of said bolt receiving face plate disposed against said bottom;

a mounting screw extending through said mounting screw aperture to threadedly engage said jamb and said door support frame;

at least one face plate anchor cylinder attached to said back surface of said bolt receiving face plate, said at least one face plate anchor cylinder closely received in said bore and extending into said door support frame;

a door stop plate disposed substantially parallel to said bolt receiving face plate, said door stop plate having a stop plate first edge, a stop plate second edge opposite said stop plate first edge, a front surface, and an opposing back surface;

a second mortise portion in said door stop member, said second mortise portion having a second bottom, said second bottom having a second bore extending through said door jamb and into said door support frame, with said back surface of said door stop plate disposed against said second bottom;

at least one door stop anchor cylinder attached to said back surface of said door stop plate, said at least one door stop anchor cylinder closely received in said second bore and extending into said door support frame; and an offset plate having opposite edges respectively joined to said face plate first edge and said stop plate first edge.

9. A strike plate for use with a door jamb of the type having an inner bolt receiving face and a door stop portion, said strike plate comprising:

a bolt receiving face plate having a bolt receiving aperture and including a face plate first edge, a face plate second edge opposite said face plate first edge, and a plurality of spaced apart mounting screw apertures;

a first anchor cylinder and second anchor cylinder spaced apart and attached to said bolt receiving face plate, each of said first anchor cylinder and said second anchor cylinder projecting substantially normal to said bolt receiving face plate in a first direction and adapted to be inserted through the bolt receiving face and into an underlying door support structure to reinforce the mounting of said strike plate to the door jamb;

a door stop plate disposed substantially parallel to said bolt receiving face plate, said door stop plate having a stop plate first edge, and a stop plate second edge opposite said stop plate first edge;

a third anchor cylinder, fourth anchor cylinder, and fifth anchor cylinder spaced apart and attached to said door stop plate, each of said third anchor cylinder, fourth anchor cylinder, and fifth anchor cylinder projecting substantially normal to said door stop plate in said first direction and adapted to be inserted through the door stop portion and into the underlying door support structure to reinforce the mounting of said strike plate to the door jamb; and an offset plate having opposite edges respectively joined to said face plate first edge and said stop plate first edge, said offset plate disposed generally normal to said bolt receiving face plate and said door stop plate.

* * * * *